United States Patent [19]

Wilson et al.

[11] 4,438,863

[45] Mar. 27, 1984

[54] GAS VENTING FLOATING COVER

[75] Inventors: John V. Wilson, Islington, Canada; William B. Kays, La Habra, Calif.

[73] Assignee: Globe Linings, Inc., Long Beach, Calif.

[21] Appl. No.: 293,701

[22] Filed: Aug. 17, 1981

[51] Int. Cl.[3] ..... B65D 51/16

[52] U.S. Cl. ..... 220/227; 220/219

[58] Field of Search ..... 220/216, 219, 226, 227, 220/368

[56] References Cited

U.S. PATENT DOCUMENTS

Re. 30,146 11/1979 Dial et al. ..... 220/219

3,980,199 9/1976 Kays ..... 220/227

*Primary Examiner*—Steven M. Pollard

*Assistant Examiner*—David Voorhees

*Attorney, Agent, or Firm*—Fulwider, Patton, Rieber, Lee & Utecht

[57] ABSTRACT

A gas venting floating cover for a liquid container, the cover including a continuous sheet of flexible material adapted to lie upon the liquid in the container in coextensive relationship therewith for attachment to the container sides in fluid tight relationship. Flotation blocks are attached to the cover to define gas collection spaces for receiving gas evolving from the liquid. The flotation blocks include first and second strings of blocks transversely spaced apart to define a longitudinal passage, certain of the blocks of each string being longitudinally spaced-apart to define transverse passages in communication with the longitudinal passage. A gas collection conduit is attached to the first and second strings in coextensive overlying relation to the longitudinal passage and includes gas admission openings, and a plurality of transverse straps extend between the first and second strings of blocks to constrain them against separation under the weight of the gas collection conduit.

7 Claims, 10 Drawing Figures

FIG. 4
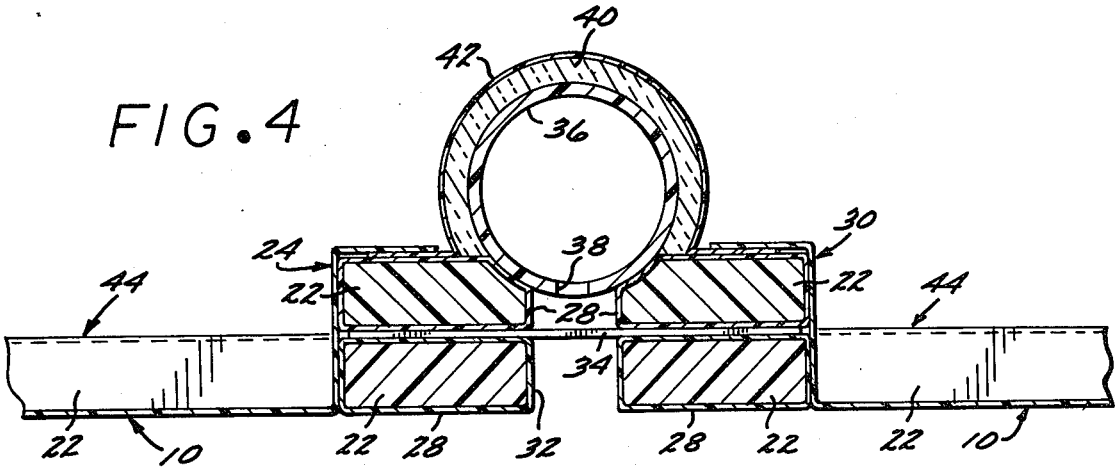
FIG. 5
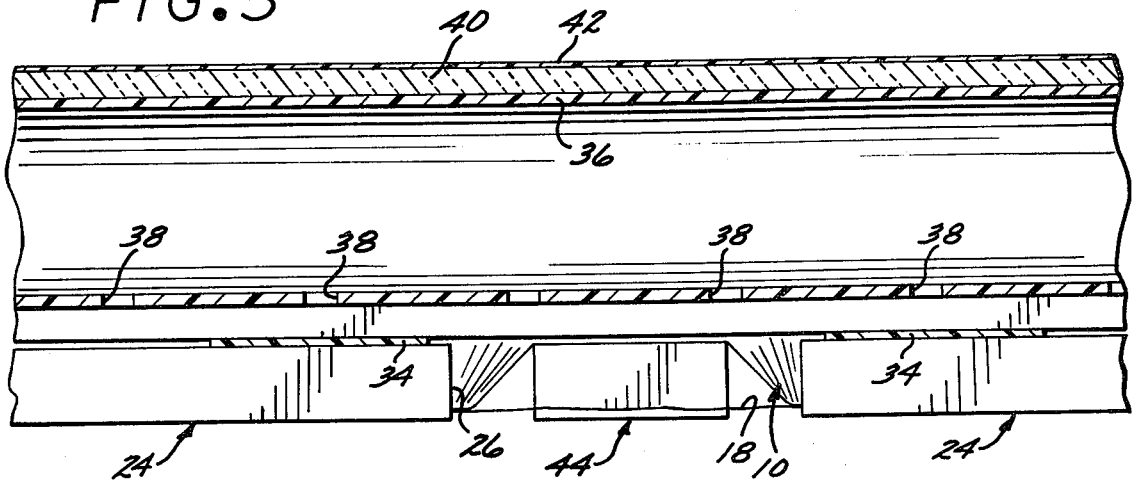
FIG. 6
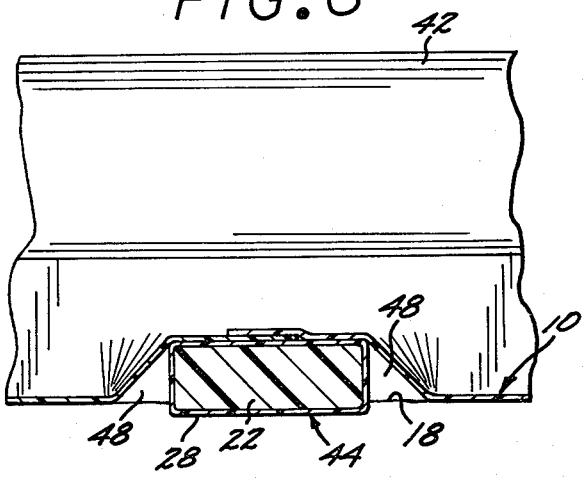
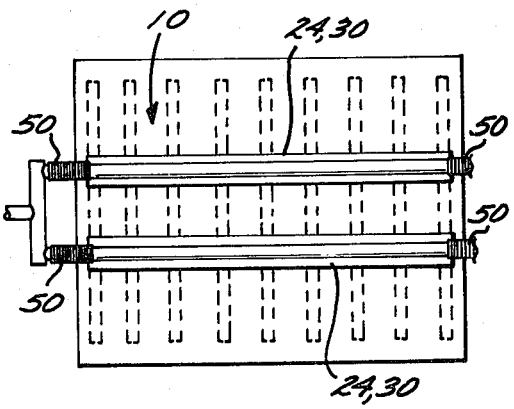
FIG. 7

GAS VENTING FLOATING COVER

BACKGROUND OF THE INVENTION

1. Field of the Invention

The present invention relates to a gas venting floating cover for a liquid container.

2. Description of the Prior Art

Relatively large volumes of methane and other gases are generated in the processing of waste products in reservoirs or containers. Floating covers are often used to prevent the escape of such gases, a floating cover suitable for this purpose being described in U.S. Letters Patent Re. No. 30,146, reissued Nov. 13, 1979, and entitled "Floating Cover For A Liquid Storage Reservoir". A cover of this general type is made of flexible sheet material buoyed upon the liquid surface by a float system which is centrally located to enable excess material at the cover perimeter to form into a depending fold. The fold acts as a rainwater collection sump. The edges of the cover are attached to the reservoir sides or perimeter in generally fluid tight relation to collect any gases evolving from the liquid.

A system of the prior art for venting collected gases from beneath a water reservoir cover is described in U.S Letters Patent No. 3,980,199, issued Sept. 14, 1976, and entitled "Gas Venting For Floating Cover". This patent discloses a system of floats which define gas passages distributed throughout the underside of the cover for collecting such gas. In one embodiment the collected gas flows to a plurality of transverse conduits embedded in a continuous string of longitudinally extending floats. Each transverse conduit is connected to a separate vertical riser, and all of the risers are connected to a longitudinal pipe which carries the gas to the reservoir perimeter for handling. As a consequence of the multiplicity of transverse conduits and risers, the system is relatively time consuming and expensive to install and is incapable of handling relatively large volumes of gas, such as would be evolved in a food waste processing installation.

In another embodiment disclosed in U.S. Pat. No. 3,980,199, a string of longitudinal floats intersects a plurality of transverse strings of floats, the latter extending up the adjacent sloping sides of the reservoir so that gas collected in passages defined by the transverse floats can flow into a collection conduit installed at the reservoir sidewall. This embodiment can handle larger quantities of gas but has the disadvantage that the transverse float strap prevent the peripheral portion of the cover from forming into a depending rainwater collection sump. Consequently, rainwater tends to collect in separate pockets in the individual bays defined between the transverse float strings, and its removal is a tedious procedure.

SUMMARY OF THE INVENTION

According to the present invention, a gas venting floating cover is provided which is adapted to collect and vent relatively large volumes of gas, such as would be encountered in an industrial sludge, food waste processing or analogous installation. The cover includes a continuous sheet of flexible material adapted to lie upon the liquid in the container in coextensive relation therewith for attachment to the container sides in fluid tight relationship. Flotation means attached to the cover define gas collection spaces for receiving gas evolving from the liquid, the flotation means being centrally located to enable the cover perimeter to form into a depending fold for the collection of rainwater.

The flotation means comprises first and second strings of longitudinally extending flotation blocks transversely spaced apart to define a longitudinal passage. Certain of the blocks of each string are spaced apart or configured to define transverse passages adapted to accept collected gas from the underside of the adjacent cover sections for admission to the longitudinal passage between the first and second strings of blocks.

A relatively large diameter longitudinal conduit or gas collection means is attached to the first and second strings of flotation blocks in coextensive, overlying relation to the longitudinal passage. A plurality of openings along the length of the longitudinal conduit admit gas from the longitudinal passage, and this gas is transported by the longitudinal conduit to the container perimeter for further handling or processing. Flexible connectors extend between the container perimeter and one or both ends of the longitudinal conduit to facilitate upward and downward movement of the cover during changes in liquid level in the container.

The present cover thus enables the flexible sheet material at the cover perimeter to form into a depending rainwater collection sump and, further, provides relatively large gas passages for venting relatively large volumes of gas from beneath the cover.

Other objects and features of the invention will become apparent from consideration of the following description taken in connection with the accompanying drawings.

DESCRIPTION OF THE DRAWINGS

FIG. 4 is an enlarged view taken along the line 4—4 of FIG. 1;

FIG. 5 is an enlarged view taken along the line 5—5 of FIG. 1;

FIG. 6 is an enlarged view taken along the line 6—6 of FIG. 1; and

FIG. 7 is a top plan view of a second embodiment of the present gas venting floating cover.

DESCRIPTION OF THE PREFERRED EMBODIMENTS

Figure 1:
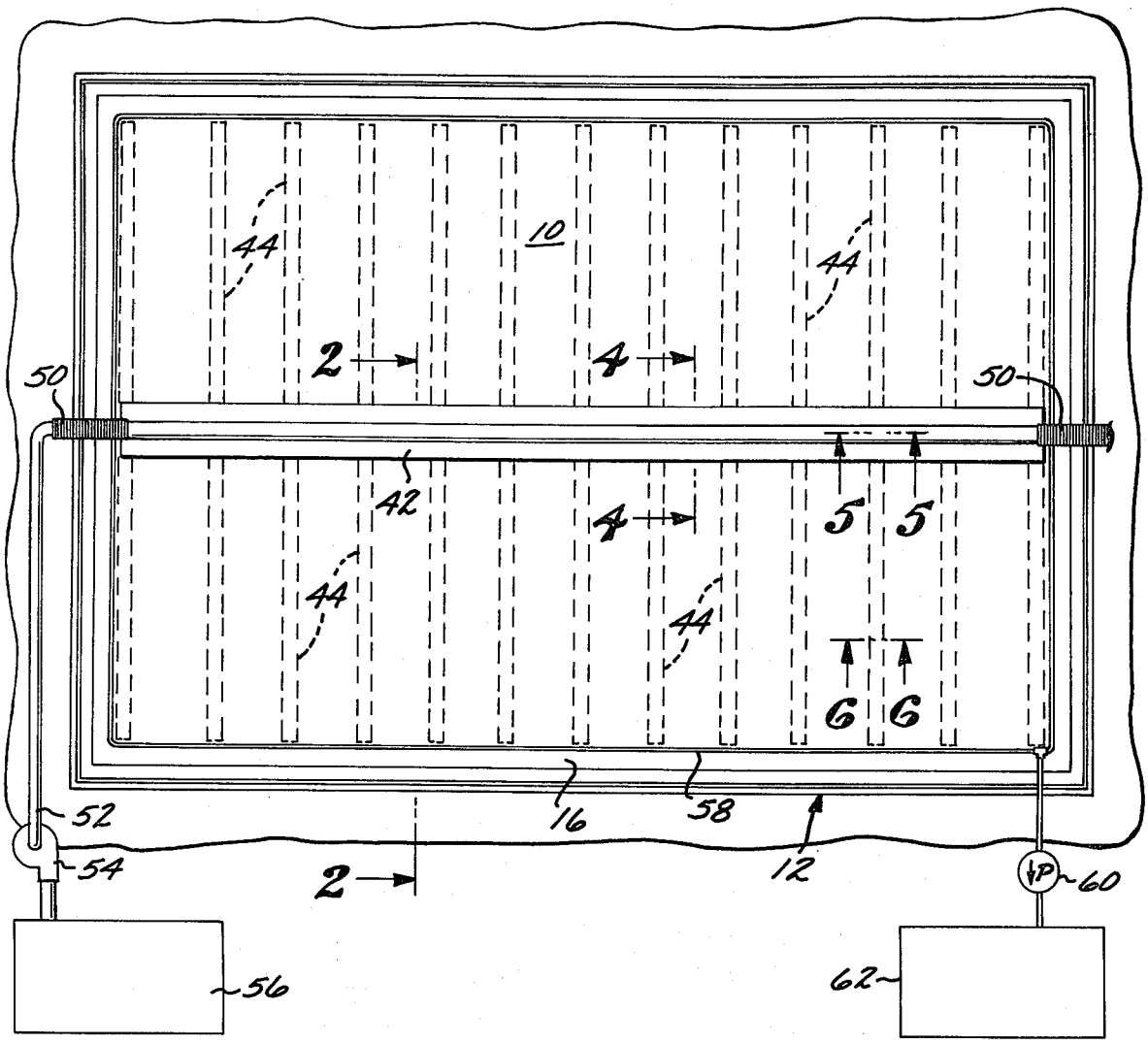
FIG. 1 is a top plan view of the present gas venting floating cover installed upon a liquid container.

Referring now to the drawings, and particularly to FIGS. 1-6, there is illustrated a floating cover designated generally by the numeral 10, and installed in overlying relation to a rectangular reservoir or container 12 characterized by generally vertical sidewalls 14. Of course, the cover 10 is equally suited for use with a reservoir or container having sloping sidewalls. The cover 10 has a surface area larger than the surface area of any horizontal plane intersecting the sidewalls 14 so that the outer perimetrical portion of the cover is adapted, as will be seen, to form into a depending fold or rainwater sump 16 for the collection of rainwater.

The cover 10 is a continuous sheet of flexible, relatively thin material, such as is more particularly described in the previously discussed U.S. Pat. No. 3,980,199, and lies upon and coextensive with the upper surface of the liquid in the container 12.

If the contained liquid being treated in the container 12 includes industrial sludge, food wastes and the like, the quantity of methane and other gases generated or evolved can be relatively large. For example, in one food waste processing operation in which the surface area of the contained liquid was 70,000 square feet, approximately 900,000 cubic feet of gas were evolved each day. This relatively large volume of gas requires that gas collection and venting passages be located throughout substantially the complete underside of the cover. As will be seen, this is accomplished by the cover 10 relatively inexpensively and without any need for extensive maintenance procedures.

The peripheral or free edges of the cover 10 are attached in fluid-tight relationship to the upper part of the container 12 by any suitable, peripherally continuous anchorage apparatus 20, as will be apparent to those skilled in the art.

The cover 10 is floated or buoyed upon the surface of the contained liquid 18 by a plurality of elongated floats or flotation blocks 22 arranged in alignment in the pattern illustrated in FIG. 1.

The pattern is merely exemplary and comprises a first longitudinal string 24 of flotation blocks extending longitudinally across the central portion of the cover and terminating just inside the adjacent sidewall 14. Preferably the longitudinal string 24 is defined by upper and lower strings of blocks 22 arranged or stacked together in two layers to easily and relatively inexpensively form a plurality of longitudinally spaced transverse passages, one of which is illustrated at 26 in FIG. 5. More particularly, the blocks 22 of the upper layer are arranged in longitudinally extending, end-to-end abutting relation, and are encased by an outer cover or sleeve 28 made of flexible sheet material which is preferably the same as that of the cover 10.

The lower layer of blocks 22 are also arranged in end-to-end relation, except that certain of the blocks 22 are longitudinally spaced apart to define the passages 26. The spaced segments of the lower layer of blocks 22 are also encased in sleeves 28.

A complemental, substantially identical arrangement of blocks 22 and sleeves 28 make up a second longitudinal string 30, which is arranged in parallel, transversely spaced-apart relation to the longitudinal string 24 to define a longitudinal passage 32 in communication with the transverse passages 26.

A plurality of longitudinally spaced apart, transversely extending straps 34, preferably made of the same material as that of the cover 10, are arranged along the length of the strings 24 and 30, the opposite extremities of the straps being sandwiched between the upper and lower layers of blocks 22 of the strings 24 and 30, as best seen in FIG. 4. A suitable adhesive is employed to adhere the stacked blocks to one another and to the adjacent extremities of the straps 34.

Each flotation block 22 is made of a buoyant material, such as closed cell plastic foam material or the like, and the purpose of the sleeves 28 is to protect such material and preserve the structural integrity of the block. Although not shown in detail, the sleeves 28 cover all exposed portions of the material of the blocks 22, and adjacent portions of the cover 10 are adhesively secured to the exterior sides and tops of the sleeves 28 of the strings 24 and 30.

The longitudinal passage 32 forms a relatively large opening into which collected gas may pass, as will be seen, for admission into an elongated cylindrical conduit 36 by means of a plurality of apertures or openings 38 provided at regular spaced intervals through the underside of the conduit 36.

The conduit 36 is coextensive with the strings 24 and 30, being located between them and in overlying relation to the passage 32. The confronting inner corners of the strings 24 and 30 are preferably cut away to form an arcuate cradle section for the conduit 36, as best seen in FIG. 4.

In one application for the present floating cover 10, the surface area of the contained liquid 18 was approximately 70,000 square feet, and approximately 900,000 cubic feet of methane and other gases were evolved per day. In this application the conduit 36 was made approximately 18 inches in diameter and freezing of moisture in the conduit 36 during winter was reduced by a blanket 40 of suitable heat insulating material arranged over the exterior of the conduit 36 and terminating at the tops of the adjacent strings 24 and 30.

The blanket 40 and conduit 36 are held in position by a sheet of flexible material 42, preferably made of the same material as that of the cover 10, adhesively secured over the blanket 40. The edge portions of the material 42 are also adhesively secured to the upper surfaces of the strings 24 and 30 and to the undersurfaces of the adjacent margins of the cover 10, as best seen in FIG. 4. In this regard, since the conduit 36 is relatively large and therefore heavy enough to tend to move the strings 24 and 30 apart, the number and thickness of the straps 34 are designed to prevent this.

The conduit 36 and longitudinal strings 24 and 30 constitute a central gas collection manifold for receiving gas collected from throughout the underside of the cover 10. The collection of such gas is facilitated by using a plurality of longitudinally spaced apart lateral or transverse strings 44 of blocks 22 arranged in continuous, end-to-end relation, each string 44 being encased in a sleeve 28 for the purposes already described in connection with the longitudinal strings 24 and 30.

Figure 2:
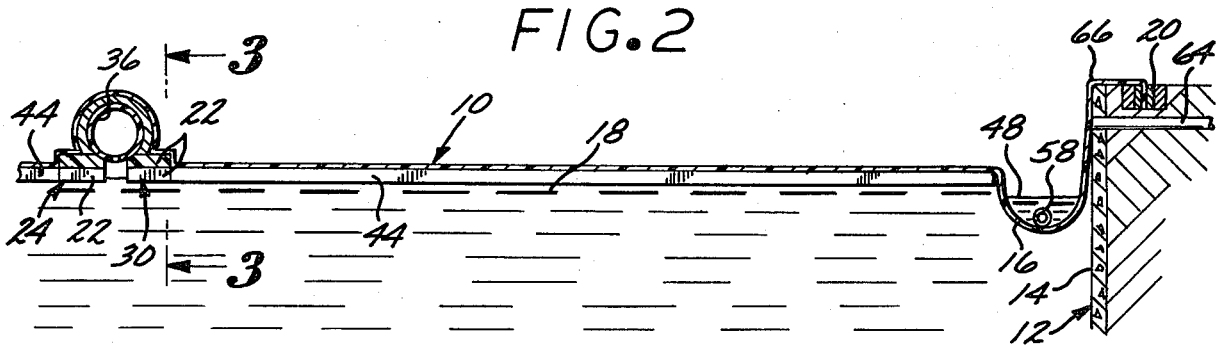
FIG. 2 is an enlarged view taken along the line 2—2 of FIG. 1.

The outer ends of the strings 44 terminate just inside of the side walls 14 so that excess cover material at the cover perimeter is unsupported and thereby capable of forming into the depending fold or sump 16 for collection of rainwater, as indicated at 48 in FIG. 2. The inner ends of the strings 44 terminate adjacent the aligned transverse passages 26 of the longitudinal strings 24 and 30.

The upper sides of the sleeves 28 of the strings 44 are adhesively secured to the underside of the cover 10. Each string 44 is buoyed upwardly relative to the stored liquid 18, as seen in FIG. 6, and the material of the cover 10 adjacent the sides of the string 44 is arranged to define generally triangular, downwardly open collection spaces 48 for receiving and carrying away gases evolving upwardly from the stored liquid.

The spaces 48 extend into communication with the transverse passages 26 so that gases rising from the liquid against all portions of the underside of the cover 10 are routed to the conduit 36.

It will be understood that the material of the cover 10 is conformed for smooth adhesive securement to all interfitting portions of the cover 10 and strings 24, 30 and 44.

Figure 3:
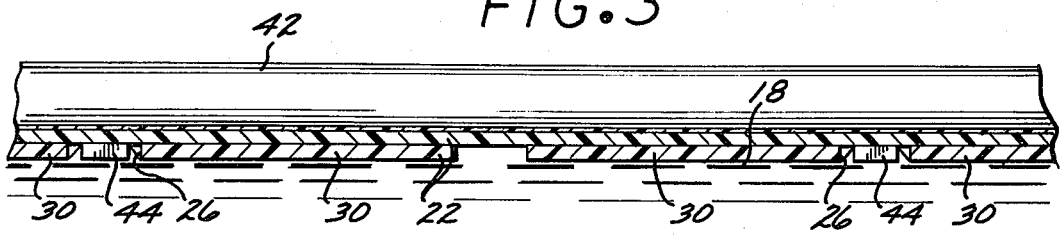
FIG. 3 is a view taken along the line 3—3 of FIG. 2.

As best seen in FIG. 3, the transverse passages 26 of the strings 24 and 30 are aligned adjacent each of the transverse strings 44, and preferably are also located at points approximately midway between adjacent strings 44.

As diagrammatically indicated in FIG. 1, the opposite outer extremities of the conduit 36 are connected to suitable flexible conduits 50 which in turn are connected to vent pipes, one of which is illustrated at 52. The pipes 52 extend to conventional pumps 54 which are operative to pump the gases into a collector tank, scrubber, burner or other apparatus 56 for treating or disposing of the collected gases.

The flexible conduits 50 accommodate vertical movement of the cover 10 as the liquid level changes in the container 12.

With the foregoing arrangement, gases evolving from the liquid 18 pass upwardly and tend to collect in the spaces 48, next passing along the lengths of the transverse strings 44 and into the transverse passages 26. From there the gases flow into the longitudinal passage 32, through the openings 38, into the conduit 36 and then to the treatment apparatus 56.

If desired, vent pipes 64 can be installed in the walls of the container 12 to carry off any gases which may collect outwardly of the depending sump 16, as best seen in FIG. 1. Alternatively, vent openings can be provided at spaced intervals along the cover perimeter, the location of one such opening being indicated at 66 in FIG. 2.

The number and arrangement of the strings 24, 30 and 44 can be varied as needed to provide adequate spaces 48 for the rate of gas evolution anticipated for the particular container 12. Thus, as seen in FIG. 7, two sets of longitudinal strings 24 and 30 may be used where the volumes of gas evolved are very great.

Figure 8:
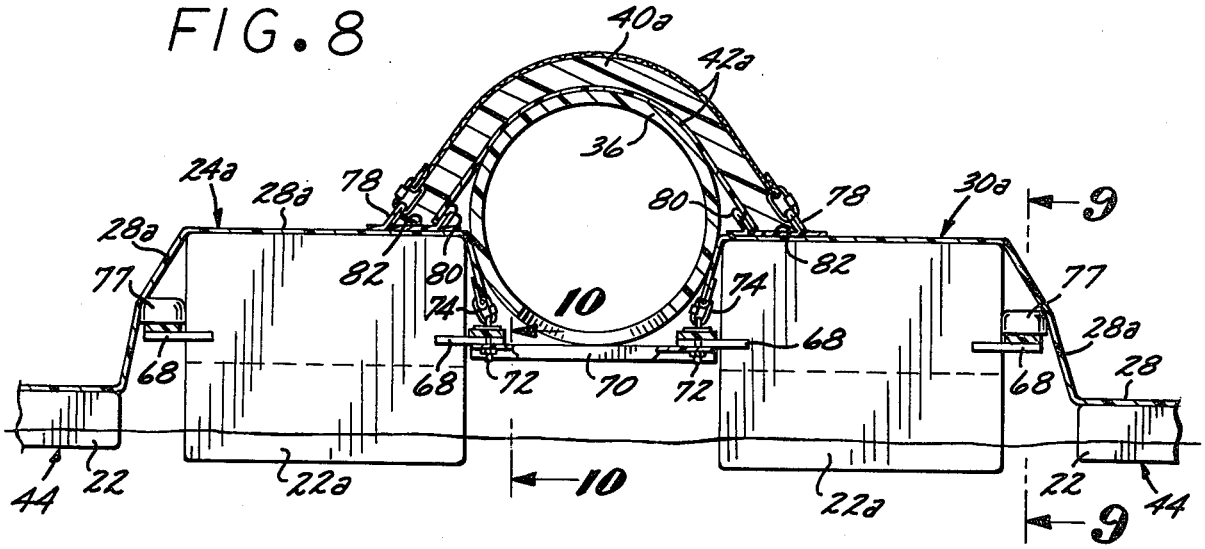
FIG. 8 is a transverse cross sectional view of a third embodiment of the present gas venting floating cover.
Figure 9:
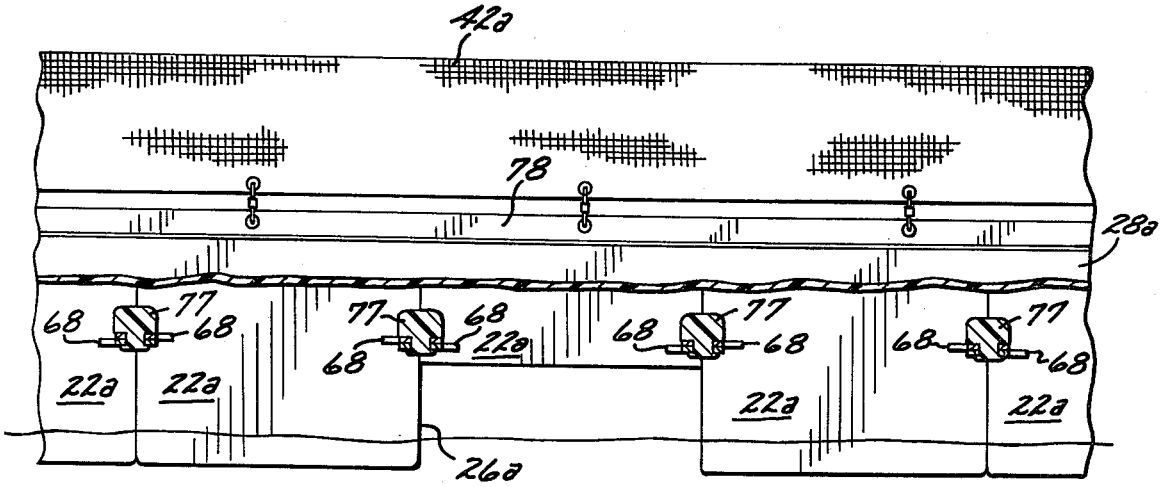
FIG. 9 is a view taken along the line 9—9 of FIG. 8.
Figure 10:
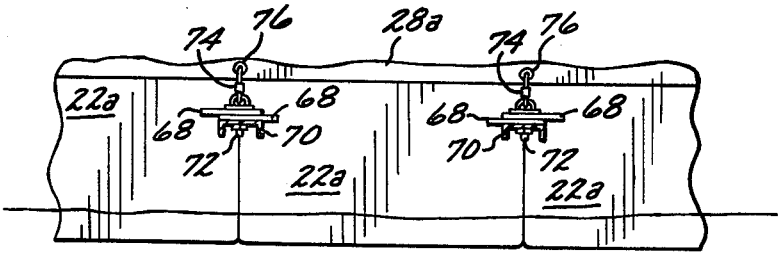
FIG. 10 is a view taken along the line 10—10 of FIG. 8.

A third embodiment of the present cover 10 is illustrated in FIGS. 8 through 10. In this embodiment a plurality of generally cube shape flotation blocks **22*a* are arranged in end-to-end adjacent relation to form a first longitudinal string 24*a*. A corresponding plurality of similarly disposed flotation blocks 22*a* define a second longitudinal string 30*a*. As in the case of the previously described embodiments, the strings 24*a* and 30*a* are arranged in transversely spaced-apart and parallel relation to define a longitudinal passage 32 between them. In addition, the strings 24*a* and 30*a* are provided, at equally spaced intervals along their lengths, with transversely aligned transverse passages 26*a*, as seen in FIG. 9. These are conveniently formed by cutting away the lower half of the confronting flotation blocks 22*a* located where the passages 26*a*** are desired.

The passages **26*a* are aligned with the inner terminii of the transverse strings 44 which float the main portion of the cover 10. As will be seen, gases rising from the liquid beneath the cover 10 collect in the spaces 48 of the strings 44 and from there are carried through the passages 26*a* and into the longitudinal passage 32**.

Although each block **22*a* may be formed of any suitable material, it preferably is a hollow structure made of molded polyethylene material provided with integral mounting straps 68 extending laterally from each corner of the block and located approximately midway between the block top and bottom, as best seen in FIG. 10**.

The mounting straps 68 of adjacent blocks **22*a* are secured together to form the strings 24*a* and 30*a*. In addition, the inner straps 68 located adjacent the longitudinal passage 32 are also secured to transversely disposed metal straps or channels 70 to maintain a predetermined spaced relation between the strings 24*a* and 30*a*, and also to support the weight of the centrally located gas collection conduit 36**.

The pair of fasteners 72 which connect the mounting straps 68 to the opposite ends of each channel 70 also form anchorages for a pair of links 74. These links are disposed through a series of grommets 76 provided in the edges of a pair of outer covers or sleeves **28*a*. The sleeves 28*a* are made of flexible sheet material preferably the same as that of the cover 10 and extend across the inner upper corners and upper sides of the blocks 22*a* of the strings 24*a* and 30*a*, respectively, as best seen in FIG. 8**.

The outer edges of the pair of sleeves **28*a* are adhesively secured to the material of the cover 10 on each side of the longitudinal passage 32**.

The inner ends of the strings 44 are located adjacent the transverse passages **26*a* and are connected to the blocks 22*a* only by the sheet material of the cover 10. This allows limited vertical and transverse movement of the strings 44 relative to the blocks 22*a*. Under some operating conditions this relatively flexible arrangement enables the components of the cover 10 to better withstand operating stresses as compared, for example, to a rigid interconnection between the strings 44 and the blocks 22*a***.

The fasteners 72 which connect the laterally outwardly located mounting straps 68 are each preferably characterized by a generally rounded top 77 to avoid chafing the adjacent underside of the sleeve **28*a***.

A thermal insulating blanket **40*a* overlying the longitudinal conduit 36 is disposed or sandwiched between sheets 42*a* of flexible material whose lateral edges are adhesively or otherwise secured, respectively, to longitudinally extending folds or seams formed integral with a pair of longitudinal reinforcing strips 82 which are adhered to the adjacent sleeves 28*a*, respectively. If desired, the outer one of the flexible sheets 42*a* can be a netting material so that the blanket 40*a*** can more easily dry should it become wet.

With the foregoing arrangement a more rugged support for the relatively heavy conduit **36*a* is provided, and a greater degree of relative movement is permissible between the central float structure and the floats 22 of the transverse strings 44**.

All of the described embodiments of the floating cover 10 provide means for carrying off relatively high volumes of gases, while yet enabling the material of the cover 10 to form into depending folds, as would be necessary where such a fold was to be used as a rainwater collection sump 16. When so used, a perimetrically arranged collection pipe 58 is preferably located in the sump 16, as best seen in FIGS. 1 and 2, to enable a pump 60 to draw off the water for suitable disposition, such as collection in a tank 62.

Various modifications and changes may be made with regard to the foregoing detailed description without departing from the spirit of the invention.

We claim:

1. A gas venting floating cover for a liquid container wherein said cover includes a sheet of flexible material for lying upon the contained liquid and for attachment to the container sides in fluid tight relationship, the sheet having excess material at its perimeter to form into a depending fold; flotation means attached to said cover and defining gas collection spaces for receiving gases evolving from said liquid; and gas collection means for receiving and carrying away gases collecting in said collection spaces, said cover being characterized in that:

said flotation means comprises generally parallel first and second strings of floats spaced apart to define a longitudinal passage, certain of said floats in each of said first and second strings defining transverse passages in communication with said longitudinal passage;

connecting means extending between and connecting together said first and second strings and preventing said first and second strings from moving apart; and, said gas collection means comprises a conduit resting upon and mounted between said first and second strings in coextensive, overlying relation to said longitudinal passage, said conduit being buoyed in substantially stable relation by said first and second strings, said gas collection means further comprising flexible connector means and piping coupled to said conduit for bridging the perimetrical fold in said sheet of said cover.

2. A gas venting floating cover according to claim 1 wherein said floats of each of said first and second strings are arranged in two stacked layers, the upper one of said layers being continuous, and the lower one of said layers being discontinuous at predetermined intervals to define said transverse passages.

3. A gas venting floating cover according to claim 1 and including a plurality of transverse strings of floats intersecting said first and second strings and defining gas collection spaces in communication with said transverse passages.

4. A gas venting floating cover according to claim 1 wherein said conduit is cylindrical and includes a plurality of openings in its underside in communication with said longitudinal passage.

5. A gas venting floating cover according to claim 1 wherein said first and second strings of floats include downwardly open tunnels defining said transverse passages.

6. A gas venting floating cover according to claim 1 wherein said connecting means comprise a plurality of longitudinally spaced metal connectors integrally secured to said first and second strings.

7. A gas venting floating cover according to claim 1 wherein said flotation means further comprises a plurality of transverse strings of floats terminating in adjacent spaced relation to said first and second strings whereby relative vertical and transverse movement therebetween is permitted.

* * * * *